US007013804B2

(12) United States Patent
Chelvayohan

(10) Patent No.: US 7,013,804 B2
(45) Date of Patent: Mar. 21, 2006

(54) METHOD OF INK LEVEL DETERMINATION FOR MULTIPLE INK CHAMBERS

(75) Inventor: Mahesan Chelvayohan, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 267 days.

(21) Appl. No.: 10/736,995

(22) Filed: Dec. 16, 2003

(65) Prior Publication Data

US 2005/0128230 A1 Jun. 16, 2005

(51) Int. Cl.
*B41J 2/195* (2006.01)

(52) U.S. Cl. ..... 101/355; 347/7; 347/19; 73/1.73

(58) Field of Classification Search ..... None
See application file for complete search history.

(56) References Cited

U.S. PATENT DOCUMENTS 5,508,722 A 4/1996 Saito et al.
5,519,418 A * 5/1996 Nishikawa et al. ..... 347/19
5,655,174 A 8/1997 Hirst
5,657,057 A 8/1997 Makajima et al.
5,689,290 A 11/1997 Saito et al.
5,900,888 A 5/1999 Kurosawa
5,929,885 A 7/1999 Nakajima et al.
6,012,794 A 1/2000 Nakano et al.
6,086,178 A 7/2000 Kawashima et al.
6,086,190 A 7/2000 Schantz et al.
6,293,143 B1 9/2001 Denton et al.
6,361,136 B1 3/2002 Watanabe et al.
6,412,894 B1 * 7/2002 Askren et al. ..... 347/7
6,431,670 B1 8/2002 Schantz et al.
6,494,553 B1 12/2002 Donahue et al.
6,517,182 B1 2/2003 Scardovi
6,626,510 B1 * 9/2003 Maeda ..... 347/7
6,793,305 B1 * 9/2004 Tsukada et al. ..... 347/7
6,826,952 B1 * 12/2004 Herbstritt ..... 73/149
6,871,926 B1 * 3/2005 Adkins et al. ..... 347/7
2001/0028371 A1 10/2001 Su et al.
2002/0012020 A1 1/2002 Sarmast et al.
2002/0126173 A1 9/2002 Sarmast et al.

* cited by examiner

*Primary Examiner*—Michael Tokar
*Assistant Examiner*—Shelby Fidler
(74) *Attorney, Agent, or Firm*—Elizabeth C. Jacobs, Esq.; Ronald K Aust, Esq.

(57) ABSTRACT

A method of ink level determination for multiple ink chambers includes the steps of determining a first estimated amount of a first ink in a first ink chamber; determining a second estimated amount of a second ink in a second ink chamber; measuring an amount of the second ink contained in the second ink chamber; determining an actual ink loss for the second ink chamber by finding a difference between the amount of the second ink measured in the second ink chamber and the second estimated amount of the second ink in the second ink chamber; and modifying the first estimated amount of the first ink in the first ink chamber using the actual ink loss for the second ink chamber to form a compensated first ink amount.

20 Claims, 5 Drawing Sheets

METHOD OF INK LEVEL DETERMINATION FOR MULTIPLE INK CHAMBERS

BACKGROUND OF THE INVENTION

1. Field of the Invention

The present invention relates to an ink jet printer, and, more particularly, to a method of ink level determination for multiple ink chambers.

2. Description of the Related Art

An ink jet printer forms an image on a print media sheet by ejecting ink from a plurality of ink jetting nozzles of an ink jet printhead to form a pattern of ink dots on the print media sheet. Such an ink jet printer may include a reciprocating printhead carrier that transports multiple ink jet printheads across the print media sheet along a bi-directional scanning path defining a print zone of the printer. Typically, a mid-frame provides media support at or near the print zone. A sheet feeding mechanism is used to incrementally advance the print media sheet in a sheet feed direction, also commonly referred to as a sub-scan direction or vertical direction, through the printer.

It is known to provide a unitary printhead cartridge that includes both a printhead and a local supply of ink. Such a printhead cartridge may include a multi-chambered ink reservoir for carrying multiple colors of ink, each chamber including a separate supply of ink of a particular color. In one printing system, for example, it is known to include cyan, magenta and yellow inks in such a multi-chambered ink reservoir.

Also, it is known to determine the amount of ink that remains in each of the chambers of a multi-chambered ink reservoir by measuring the ink levels in each chamber. Such a method, however, requires an ink level sensor of some type in each ink chamber. For example, a three-chambered ink reservoir would require three separate ink level sensors to determine the ink levels in each of the three ink chambers.

Further, it is known to estimate the amount of ink remaining in each ink chamber of a multi-chambered ink reservoir. For example, when a printhead cartridge is new, an assumed total ink volume of each color of ink is established. Then, for a particular color, the number of ink drops of that color expelled from the respective ink chamber is counted. The ink volume associated with the ink drop count is then determined, and is subtracted from the assumed total ink volume to arrive at an estimated current ink volume for the respective ink chamber. Such a basic ink level estimation method, however, does not account for extrinsic factors, such as for example, variations in drop volume due to temperature changes and/or ink loss due to evaporation.

What is needed in the art is a method of ink level determination for multiple ink chambers that does not require measuring ink levels in each chamber, and which is more accurate than a basic ink level estimation method.

SUMMARY OF THE INVENTION

The present invention provides a method of ink level determination for multiple ink chambers that does not require measuring ink levels in each chamber of the multiple ink chambers, and which is more accurate than a basic ink level estimation method.

In one form thereof, the present invention is directed to a method of ink level determination for multiple ink chambers. The method includes the steps of determining a first estimated amount of a first ink in a first ink chamber; determining a second estimated amount of a second ink in a second ink chamber; measuring an amount of the second ink contained in the second ink chamber; determining an actual ink loss for the second ink chamber by finding a difference between the amount of the second ink measured in the second ink chamber and the second estimated amount of the second ink in the second ink chamber; and modifying the first estimated amount of the first ink in the first ink chamber using the actual ink loss for the second ink chamber to form a compensated first ink amount.

In another form thereof, the present invention is directed to an ink jet printer, including a printhead carrier system including a carrier, and at least a first ink chamber and a second ink chamber. A printhead is mounted to the carrier. The printhead has a plurality of nozzles coupled in fluidic communication with the first ink chamber and the second ink chamber. A plurality of actuators is provided, with each actuator being associated with a respective nozzle of the plurality of nozzles. A sensor is configured to detect an ink level in the second ink chamber. A controller is electrically connected to the plurality of actuators and to the sensor. The controller is configured to perform the steps of determining a first estimated amount of a first ink in the first ink chamber; determining a second estimated amount of a second ink in the second ink chamber; measuring an amount of the second ink contained in the second ink chamber; determining an actual ink loss for the second ink chamber by finding a difference between the amount of the second ink measured in the second ink chamber and the second estimated amount of the second ink in the second ink chamber; and modifying the first estimated amount of the first ink in the first ink chamber using the actual ink loss for the second ink chamber to form a compensated first ink amount.

An advantage of the present invention is that it does not require measuring ink levels in each chamber of the multiple ink chambers, such as those in a multi-chambered ink reservoir, thus reducing cost.

Another advantage of the present invention is that it is more accurate than a basic ink level estimation method.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
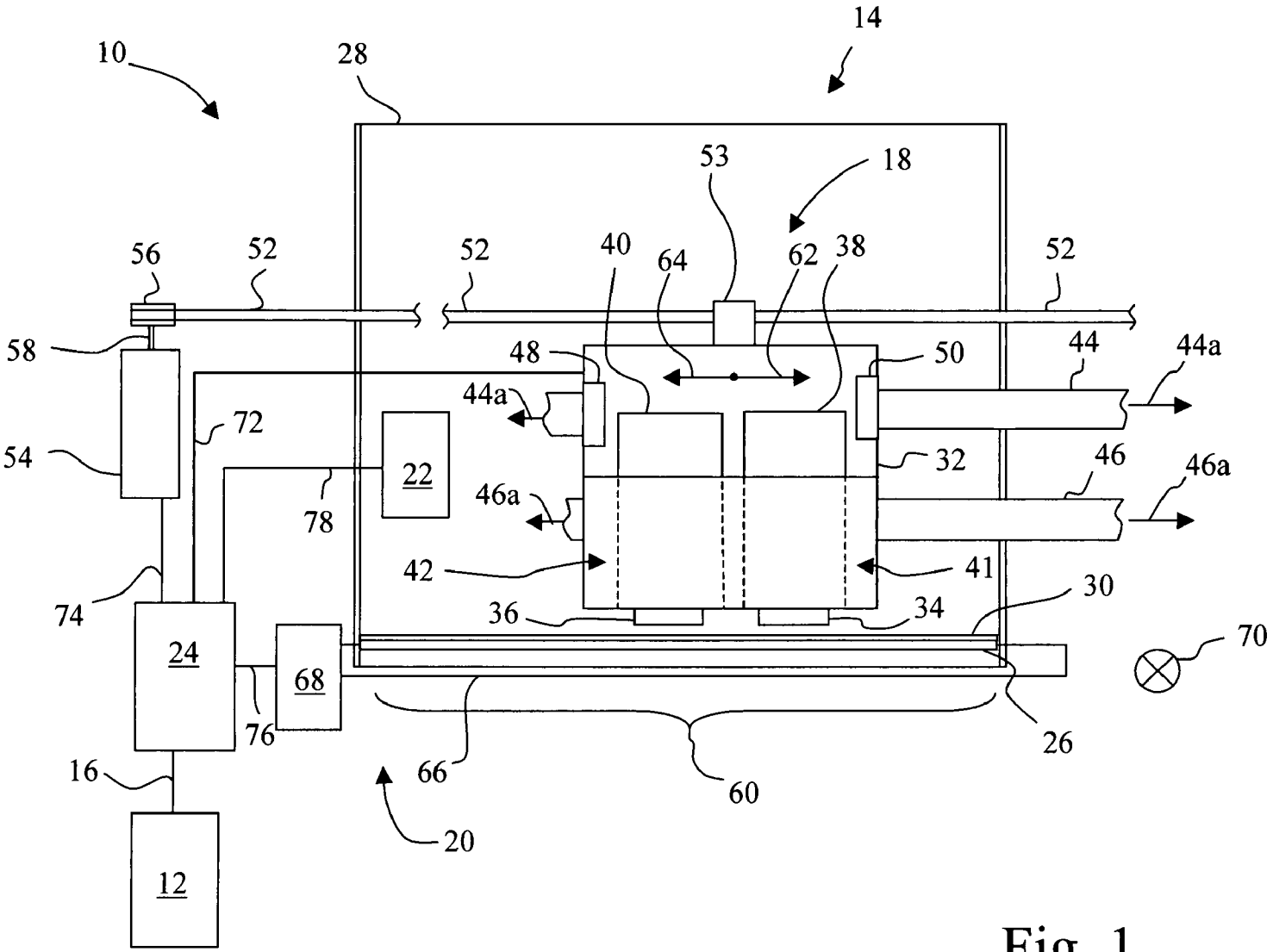
FIG. 1 is an imaging system for implementing the present invention.

Referring now to the drawings, and particularly to FIG. 1, there is shown an imaging system 10 embodying the present invention. Imaging system 10 includes a host 12 and an ink jet printer 14. Host 12 is communicatively coupled to ink jet printer 14 via a communications link 16. Communications link 16 may be, for example, a direct electrical or optical connection, or a network connection.

Ink jet printer 14 includes a printhead carrier system 18, a feed roller unit 20, a sheet picking unit 22, a controller 24, a mid-frame 26 and a media source 28.

Host 12 may be, for example, a personal computer including a display device, an input device (e.g., keyboard), a processor, input/output (I/O) interfaces, memory, such as RAM, ROM, NVRAM, and a mass data storage device, such as a hard drive, CD-ROM and/or DVD units. During operation, host 12 includes in its memory a software program including program instructions that function as a printer driver for ink jet printer 14. The printer driver is in communication with controller 24 of ink jet printer 14 via communications link 16. The printer driver, for example, includes a halftoning unit and a data formatter that places print data and print commands in a format that can be recognized by ink jet printer 14. In a network environment, communications between host 12 and ink jet printer 14 may be facilitated via a standard communication protocol, such as the Network Printer Alliance Protocol (NPAP).

Media source 28 is configured to receive a plurality of print media sheets from which a print medium, e.g., a print media sheet 30, is picked by sheet picking unit 22 and transported to feed roller unit 20, which in turn further transports print media sheet 30 during a printing operation. Print media sheet 30 can be, for example, plain paper, coated paper, photo paper or transparency media.

Printhead carrier system 18 includes a printhead carrier 32 for mounting and carrying a standard color printhead 34 and a photo printhead 36. A standard color multi-chambered ink reservoir 38 is provided in fluid communication with standard color printhead 34, and a photo multi-chambered ink reservoir 40 is provided in fluid communication with photo printhead 36. Those skilled in the art will recognize that color printhead 34 and color multi-chambered ink reservoir 38 may be formed as individual discrete units, or may be combined as an integral unitary printhead cartridge 41. Likewise, photo printhead 36 and photo multi-chambered ink reservoir 40 may be formed as individual discrete units, or may be combined as an integral unitary printhead cartridge 42.

In the embodiment shown in FIG. 1, printhead carrier 32 is guided by a pair of guide members 44, 46, such as guide rods. Each of guide members 44, 46 includes a respective horizontal axis 44*a*, 46*a*. Printhead carrier 32 may include a pair of guide rod bearings 48, 50, each of guide rod bearings 48, 50 including a respective aperture for receiving guide member 44. Printhead carrier 32 further includes a glide surface (not shown) that is retained in contact with guide member 46, for example, by gravitational force, or alternatively, by another guide rod bearing or bearing set. The horizontal axis 44*a* of guide member 44 generally defines a bi-directional scanning path for printhead carrier 32, and thus, for convenience the bi-directional scanning path will be referred to as bi-directional scanning path 44*a*. Accordingly, bi-directional scanning path 44*a* is associated with each of printheads 34, 36.

Printhead carrier 32 is connected to a carrier transport belt 52 via a carrier drive attachment device 53. Carrier transport belt 52 is driven by a carrier motor 54 via a carrier pulley 56. Carrier motor 54 has a rotating carrier motor shaft 58 that is attached to carrier pulley 56. At the directive of controller 24, printhead carrier 32 is transported in a reciprocating manner along guide members 44, 46. Carrier motor 54 can be, for example, a direct current (DC) motor or a stepper motor.

The reciprocation of printhead carrier 32 transports ink jet printheads 34, 36 across the print media sheet 30, such as paper, along bi-directional scanning path 44*a* to define a print zone 60 of ink jet printer 14. The reciprocation of printhead carrier 32 occurs in a main scan direction (bi-directional) that is parallel with bi-directional scanning path 44*a*, and is also commonly referred to as the horizontal direction, including a left-to-right carrier scan direction 62 and a right-to-left carrier scan direction 64. Generally, during each scan of printhead carrier 32 while printing, the print media sheet 30 is held stationary by feed roller unit 20.

Mid-frame 26 provides support for the print media sheet 30 when the print media sheet 30 is in print zone 60, and in part, defines a portion of a print media path of ink jet printer 14.

Feed roller unit 20 includes a feed roller 66 and corresponding index pinch rollers (not shown). Feed roller 66 is driven by a drive unit 68. The index pinch rollers apply a biasing force to hold the print media sheet 30 in contact with respective driven feed roller 66. Drive unit 68 includes a drive source, such as a stepper motor, and an associated drive mechanism, such as a gear train or belt/pulley arrangement. Feed roller unit 20 feeds the print media sheet 30 in a sheet feed direction 70, designated as an X in a circle to indicate that the sheet feed direction is out of the plane of FIG. 1 toward the reader. The sheet feed direction 70 is commonly referred to as the vertical direction, which is perpendicular to the horizontal bi-directional scanning path 44*a*, and in turn, perpendicular to the horizontal carrier scan directions 62, 64. Thus, with respect to print media sheet 30, carrier reciprocation occurs in a horizontal direction and media advance occurs in a vertical direction, and the carrier reciprocation is generally perpendicular to the media advance.

Controller 24 includes a microprocessor having an associated random access memory (RAM) and read only memory (ROM). Controller 24 executes program instructions to effect the printing of an image on the print media sheet 30, such as for example, by selecting the index feed distance of print media sheet 30 along the print media path as conveyed by feed roller 66, controlling the reciprocation of printhead carrier 32, and controlling the operations of printheads 34, 36.

Controller 24 is electrically connected and communicatively coupled to printheads 34, 36 via a communications link 72, such as for example a printhead interface cable. Controller 24 is electrically connected and communicatively coupled to carrier motor 54 via a communications link 74, such as for example an interface cable. Controller 24 is electrically connected and communicatively coupled to drive unit 68 via a communications link 76, such as for example an interface cable. Controller 24 is electrically connected and communicatively coupled to sheet picking unit 22 via a communications link 78, such as for example an interface cable.

Figure 2:
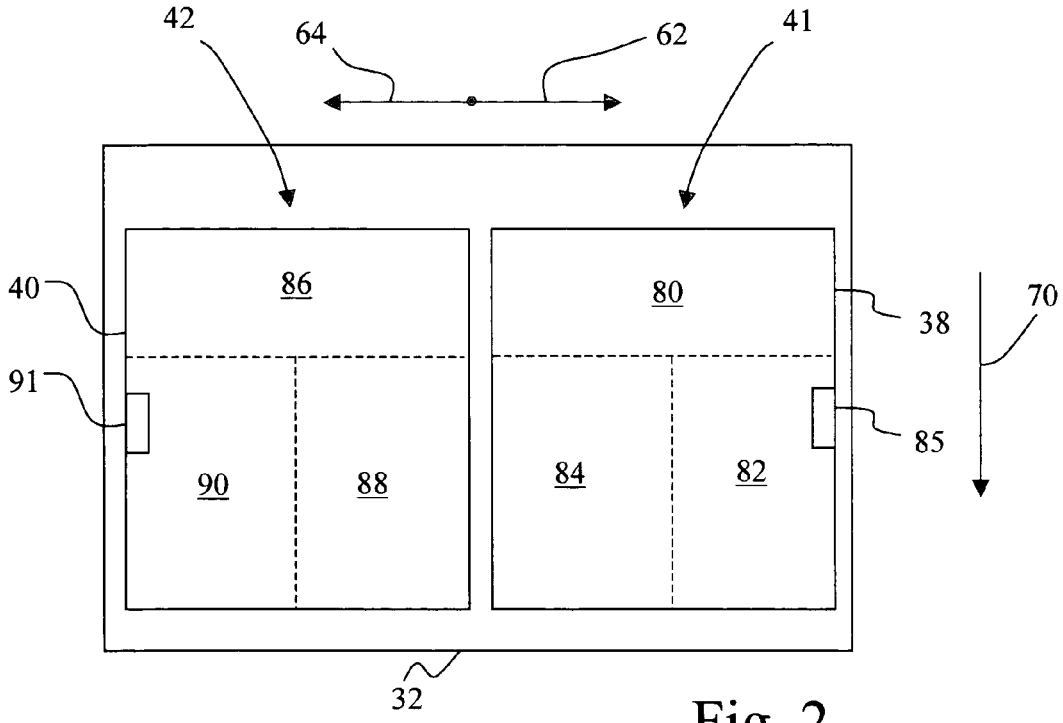
FIG. 2 is a top diagrammatic view of a printhead carrier of the imaging system of FIG. 1, which mounts a plurality of unitary printhead cartridges, with the respective ink chamber dividing walls inside the unitary printhead cartridges represented by dashed lines.

Referring now to FIG. 2 in relation to FIG. 1, there is shown a top view of printhead carrier 32 that mounts unitary printhead cartridge 41 and unitary printhead cartridge 42, with the respective ink chamber dividing walls represented by dashed lines. Accordingly, printhead carrier 32 mounts standard color printhead 34 and photo printhead 36 via their respective printhead cartridges 41, 42.

Unitary printhead cartridge 41 includes standard color multi-chambered ink reservoir 38 coupled in fluid communication with the standard color printhead 34 via a plurality of internal conduits, in a manner known in the art. Standard color multi-chambered ink reservoir 38 includes a plurality of ink chambers, and in the embodiment shown, three ink chambers 80, 82 and 84, which contain, for example, three standard, e.g., full-strength, chromatic inks such as for example, a magenta ink, a cyan ink and a yellow ink, respectively. Ink chambers 80, 82 and 84 may be configured to define substantially the same volume, and thus may contain substantially the same amount of each of the respective inks. Also, each of the inks in ink chambers 80, 82 and 84 may be, for example, a pigment-based ink or a dye-based ink.

One of the ink chambers of standard color multi-chambered ink reservoir 38, such as for example, ink chamber 82, includes a sensor 85. Sensor 85 is mounted, for example, to a sidewall of multi-chambered ink reservoir 38. Sensor 85 is connected via communications link 72 to controller 24, and is configured to detect, e.g., measure, an ink level in ink chamber 82 of multi-chambered ink reservoir 38. Information relating to the measured ink level in ink chamber 82 is supplied via communications link 72 to controller 24 for further processing, if necessary, and is stored in memory of controller 24 as the measured ink level of ink chamber 82.

Unitary printhead cartridge 42 includes photo multi-chambered ink reservoir 40 coupled in fluid communication with the photo printhead 36 via a plurality of internal conduits, in a manner known in the art. Photo multi-chambered ink reservoir 40 includes a plurality of ink chambers, and in the embodiment shown, three ink chambers 86, 88, 90, that may respectively contain, for example, an achromatic ink, such as a black ink, and diluted chromatic inks, such as for example, a diluted magenta ink and a diluted cyan ink. Ink chambers 86, 88, 90 may be configured to define substantially the same volume, and thus may contain substantially the same amount of each of the respective inks. Also, each of the inks in ink chambers 86, 88, 90 may be, for example, a pigment-based ink or a dye-based ink.

One of the ink chambers of photo multi-chambered ink reservoir 40, such as for example, ink chamber 90, includes a sensor 91. Sensor 91 is mounted, for example, to a sidewall of photo multi-chambered ink reservoir 40. Sensor 91 is connected via communications link 72 to controller 24, and is configured to detect, e.g., measure, an ink level in ink chamber 90 of photo multi-chambered ink reservoir 40. Information relating to the measured ink level in ink chamber 90 is supplied via communications link 72 to controller 24 for further processing, if necessary, and is stored in memory of controller 24 as the measured ink level of ink chamber 90.

Figure 3:
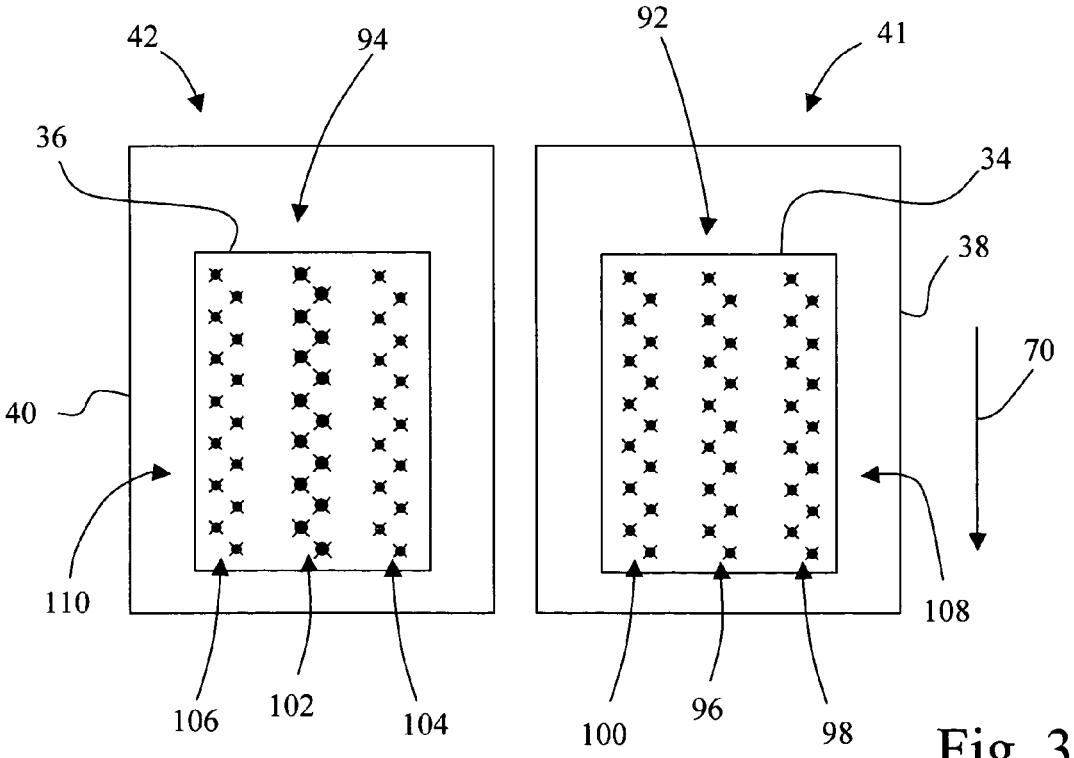
FIG. 3 is a bottom diagrammatic view of the unitary printhead cartridges of FIG. 2, showing a standard color printhead and photo printhead, each in exemplary magnified and exaggerated form.

Referring now to FIG. 3, there is shown a bottom view of unitary printhead cartridge 41, including standard color printhead 34, and of unitary printhead cartridge 42, including photo printhead 36. Standard color printhead 34 and photo printhead 36 are show in magnified and exaggerated form for clarity. Standard color printhead 34 includes a plurality of ink jetting nozzles 92 represented by dots. Also, photo printhead 36 includes a plurality of ink jetting nozzles 94 represented by dots. The number of nozzles depicted are for exemplary purposes only, and it is to be understood that the number of nozzles for a particular printhead may be dependent on design constraints associated with printheads 34, 36 and ink jet printer 14.

The plurality of ink jetting nozzles 92 of standard color printhead 34 is divided into a plurality of nozzle arrays, such as for example, a magenta nozzle array 96, a cyan nozzle array 98 and a yellow nozzle array 100. Magenta nozzle array 96 is coupled in fluid communication with ink chamber 80 that contains magenta ink. Cyan nozzle array 98 is coupled in fluid communication with ink chamber 82 that contains cyan ink. Yellow nozzle array 100 is coupled in fluid communication with ink chamber 84 that contains yellow ink. Nozzle arrays 96, 98, and 100 are arranged to be substantially parallel, and are arranged to be substantially parallel to sheet feed direction 70 when standard color printhead 34 is mounted in printhead carrier 32.

The plurality of ink jetting nozzles 94 of photo printhead 36 is divided into a plurality of nozzle arrays, such as for example, an achromatic nozzle array 102, a magenta nozzle array 104 and a cyan nozzle array 106. Achromatic nozzle array 102 is coupled in fluid communication with ink chamber 86 that contains an achromatic ink, such as for example, black ink. Magenta nozzle array 104 is coupled in fluid communication with ink chamber 88 that contains, for example, a diluted magenta ink. Cyan nozzle array 106 is coupled in fluid communication with ink chamber 90 that contains, for example, a diluted cyan ink. Nozzle arrays 102, 104 and 106 are arranged to be substantially parallel, and are arranged to be substantially parallel to sheet feed direction 70 when photo printhead 36 is mounted in printhead carrier 32.

Standard color printhead 34 includes a plurality of actuators 108 represented in FIG. 3 by Xs, with each actuator being associated with a respective nozzle of the plurality of nozzles 92. Likewise, photo printhead 36 includes a plurality of actuators 110 represented in FIG. 3 by Xs, with each actuator being associated with a respective nozzle of the plurality of nozzles 94. Each of the actuators 108, 110 may be, for example, a thermal heating element or a piezoelectric element.

Controller 24 is electrically coupled to each of the plurality of actuators 108, 110 via communications link 72, and individually and selectively controls the actuation thereof. A count of the number of ink drops fired from each of ink chambers 80, 82 and 84 of standard color multi-chambered ink reservoir 38 and ink chambers 86, 88, 90 of photo multi-chambered ink reservoir 40 may be determined, for example by controller 24, by counting the number of actuations of the respective actuators of the plurality of actuators 108 or 110 for each chamber. The respective drop counts associated with each of the ink chambers 80, 82, 84 and ink chambers 86, 88, 90 may be stored in the memory of controller 24, or in another memory location accessible by controller 24.

Figure 4:
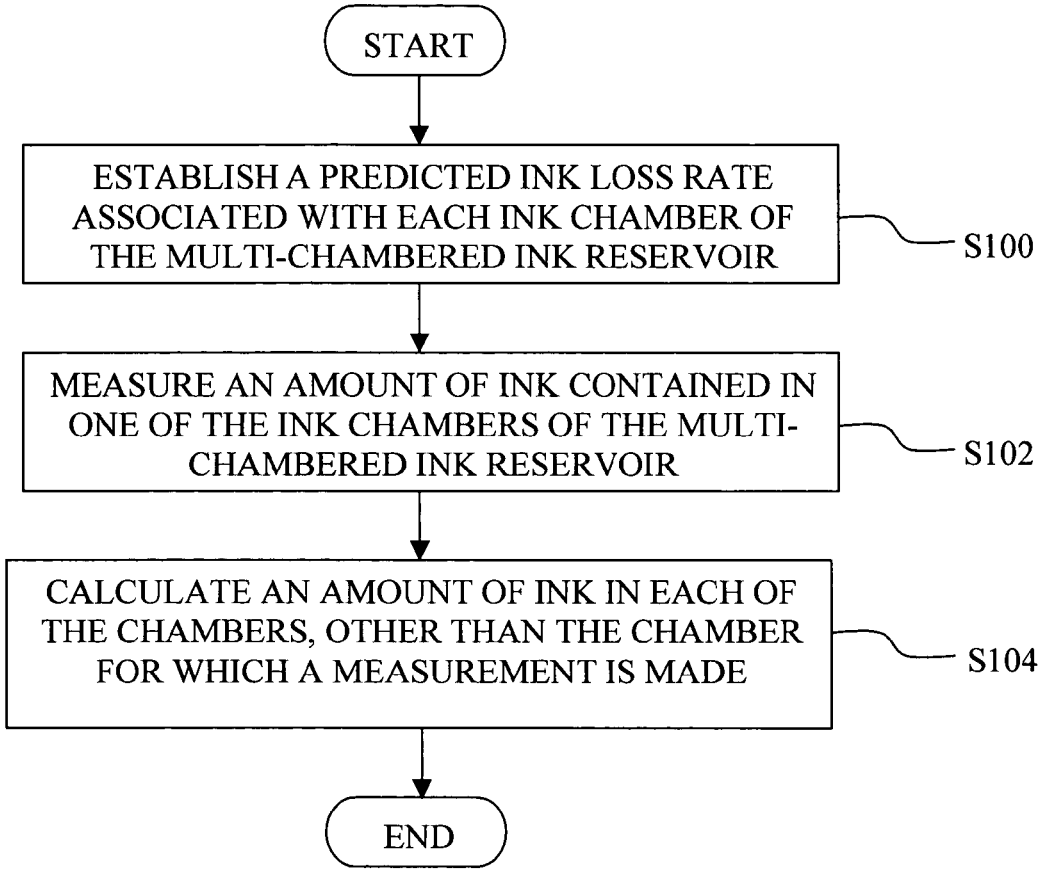
FIG. 4 is a flowchart of a general method of ink level determination for multiple ink chambers, such as those in a multi-chambered ink reservoir, in accordance with the present invention.

FIG. 4 is a flowchart of a method of ink level determination for multiple ink chambers, such as for example a multi-chambered ink reservoir, in accordance with the present invention, and is described with reference to FIGS. 1–3. For simplicity and ease of understanding of the invention, the method will be described using multi-chambered ink reservoir 38 as an example. It is to be understood, however, that the invention may be used with either or both of multi-chambered ink reservoirs 38 and 40, or with multiple separated ink chambers. Further, while multi-chambered ink reservoirs 38 and 40 each have multiple chambers arranged in a T-configuration, it is contemplated that the method of the invention may be practiced with other chamber configurations having two or more ink chambers. In addition, while multi-chambered ink reservoirs 38 and 40 each are formed as an integral unit, it is contemplated that the method of the invention may be practiced wherein the chambers that are not formed as an integral unit, i.e., the ink chambers are separate and may be spaced apart.

At step S100, a predicted ink loss rate associated with each ink chamber of multi-chambered ink reservoir 38 is established. For example, a first predicted ink loss rate associated a first ink, e.g., magenta, contained in a first ink chamber, e.g., ink chamber 80, of multi-chambered ink reservoir 38 is established using empirical data. A predicted second ink loss rate associated with a second ink, e.g., cyan, in a second ink chamber, e.g., ink chamber 82 of multi-chambered ink reservoir 38 is established using empirical data. A predicted third ink loss rate associated with a third ink, e.g., yellow, contained in a third ink chamber, e.g., ink chamber 84, of multi-chambered ink reservoir 38 is established using empirical data.

Such predicted ink loss rates may be represented, for example, by a separate ink loss curve established for each chamber of a particular multi-chambered ink reservoir type. Such an ink loss curve may take into account such factors as evaporation loss based on ink type (e.g., fluid content, pigment based or dye-based, etc.) and ink chamber construction (e.g., size, shape and material for which the ink chamber is formed, and venting characteristics of the ink chamber). Other pertinent factors that may be considered include time, temperature and humidity. The ink loss rates so empirically determined may then be stored in memory, such as the memory of controller 24 of ink jet printer 14, as respective look-up tables for later identification and access by controller 24.

In some implementations of the present invention, step S100 may be optional, such as for example, if all ink chambers have substantially the same ink loss characteristics, or if a fixed relationship is associated with the ink loss rates of the first ink chamber, e.g., ink chamber 80, and the second ink chamber, e.g., ink chamber 82.

At step S102, an amount of ink contained in one of the chambers of multi-chambered ink reservoir 38 is measured. For example, the amount of the second ink, e.g., cyan ink, contained in ink chamber 82 of multi-chambered ink reservoir 38 may be measured using sensor 85, and the measured amount may be provided to controller 24 via communications link 72.

At step S104, an amount of ink in each of the chambers (e.g., first and third ink chambers 80, 84), other than the chamber for which a measurement is made at step S102 (e.g., second ink chamber 82), is calculated. Such calculations may be made using estimated amounts of the inks in the respective ink chambers (e.g., ink chambers 80, 82 and 84) and the measured amount of the second ink, e.g., cyan, in the ink chamber that was measured (i.e., ink chamber 82 having the sensor 85). An actual ink loss for the ink chamber that was measured (i.e., second ink chamber 82) may be determined by finding the difference between the amount of the second ink measured in the second ink chamber 82 and the estimated amount of the second ink. Thereafter, the estimated amounts of inks in the first and third ink chambers 80, 84 may be modified using the actual ink loss for the second ink chamber 82 to form compensated first and third ink amounts for the first and third ink chambers 80, 84 that were not measured.

For implementations of the invention that optionally perform step S100, the actual ink loss for ink chamber 82, referenced above, may be modified by a ratio formed by the first predicted ink loss rate and the second predicted ink loss rate in determining the compensated first ink amount for ink chamber 80, and the actual ink loss for ink chamber 82 may be modified by a ratio formed by the third predicted ink loss rate and the second predicted ink loss rate in determining the compensated third ink amount for ink chamber 84.

Figure 5A:
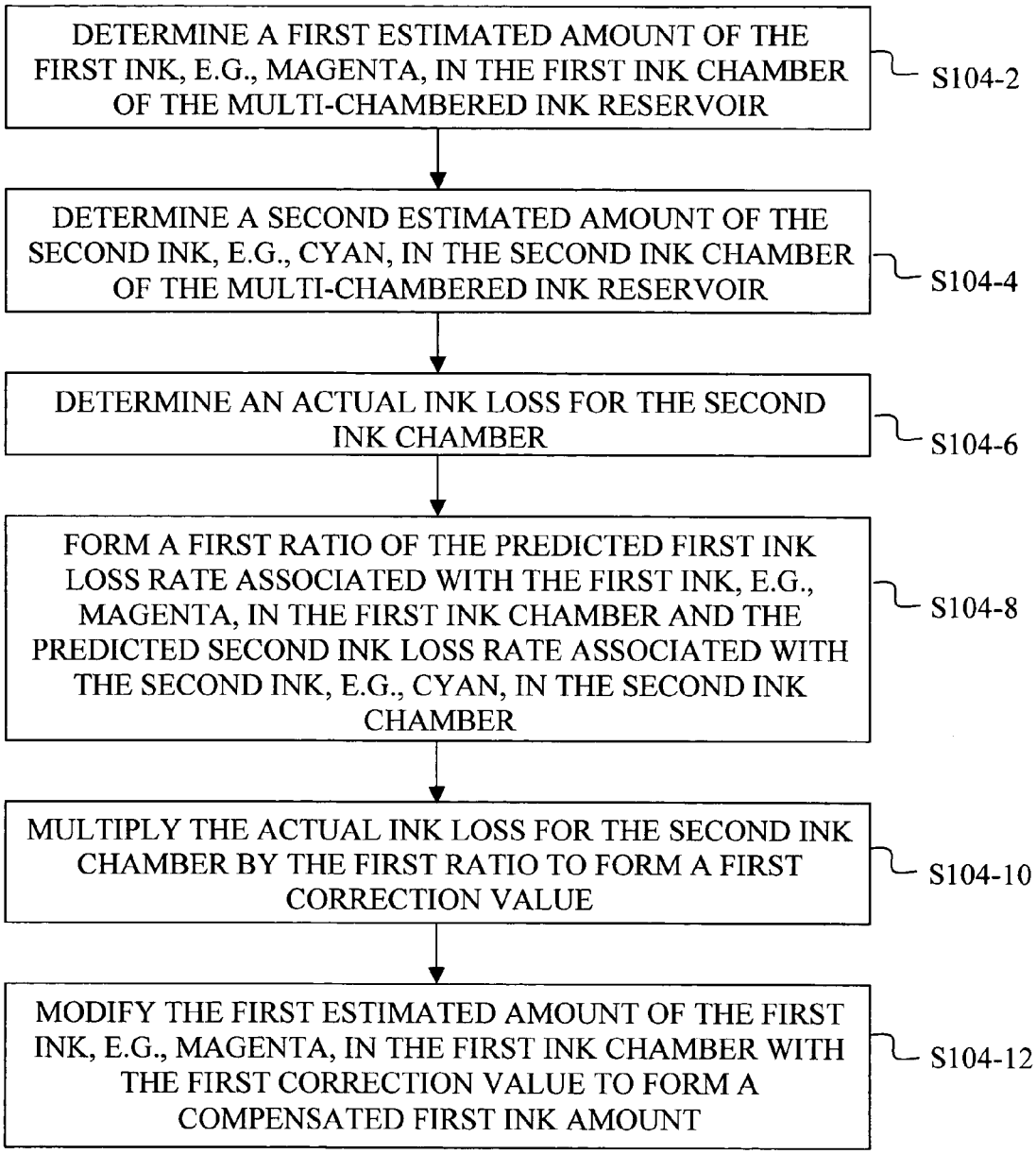
FIG. 5A is a flowchart of an exemplary calculating routine for use in implementing calculating step S104 of FIG. 4 for the first ink in the first ink chamber of the multi-chambered ink reservoir of FIG. 2.

FIG. 5A is a flowchart of an exemplary calculating routine for use in implementing calculating step S104 of FIG. 4 for determining an amount of the first ink, e.g., magenta, in ink chamber 80 of multi-chambered ink reservoir 38 of FIG. 2.

At step S104-2, a first estimated amount ($V^M_{CALC}$) of the first ink, e.g., magenta, in the first ink chamber, i.e., ink chamber 80, of multi-chambered ink reservoir 38 is determined based on a first number of ink drops ($V^M_{DROP}$) expelled from ink chamber 80. The number of ink drops expelled from ink chamber 80 may be determined, for example, by counting the number of actuations of actuators 108 associated with ink chamber 80, as described above, and may be performed, for example, by controller 24. The first estimated amount ($V^M_{CALC}$) of the first ink may be calculated by subtracting the first number of ink drops ($V^M_{DROP}$) from the total ink amount ($V^M_{TOTAL}$) originally available from the first ink chamber, i.e., ink chamber 80, e.g., $V^M_{CALC}=V^M_{TOTAL}-V^M_{DROP}$.

At step S104-4, a second estimated amount ($V^C_{CALC}$) of the second ink, e.g., cyan, in the second ink chamber, i.e., ink chamber 82, of multi-chambered ink reservoir 38 is determined using a second number of ink drops ($V^C_{DROP}$) expelled from ink chamber 82. The number of ink drops expelled from ink chamber 82 may be determined, for example by counting the number of actuations of actuators 108 associated with ink chamber 82, as described above, and may be performed, for example, by controller 24. The second estimated amount ($V^C_{CALC}$) of the second ink may be calculated by subtracting the second number of ink drops $V^C_{DROP}$ from the total ink amount $V^C_{TOTAL}$ originally available from the second ink chamber, i.e., ink chamber 82, e.g., $V^C_{CALC}=V^C_{TOTAL}-V^C_{DROP}$.

At step S104-6, an actual ink loss ($V^C_{LOSS}$) for the second ink chamber, i.e., ink chamber 82, is determined by controller 24 by finding a difference between the amount of the second ink measured ($V^C_{MEAS}$) in ink chamber 82 and the second estimated amount ($V^C_{CALC}$) of the second ink in second ink chamber 82, e.g., $V^C_{LOSS}=V^C_{CALC}-V^C_{MEAS}$.

At step S104-8, controller 24 forms a first ratio ($R_1$) of the predicted first ink loss rate associated ($L_M$) with the first ink, e.g., magenta, in ink chamber 80 and the predicted second ink loss rate ($L_C$) associated with the second ink, e.g., cyan, in ink chamber 82, e.g., $R_1=L_M/L_C$.

At step S104-10, controller 24 multiplies the actual ink loss $V^C_{LOSS}$ for the second ink chamber, i.e., ink chamber 82, by the first ratio ($R_1$) to form a first correction value ($V^M_{CORR}$), e.g., $V^M_{CORR}=V^C_{LOSS}\times R_1$, which represents the amount of ink loss from the first ink chamber, i.e., ink chamber 80.

At step S104-12, controller 24 modifies the first estimated amount ($V^M_{CALC}$) of the first ink, e.g., magenta, in ink chamber 80 with the first correction value ($V^M_{CORR}$) to form a compensated first ink amount ($V^M_{COMP}$). This step of modifying the first estimated amount of the first ink in ink chamber 80 may be performed, for example, by subtracting the first correction value from the first estimated amount of the first ink in ink chamber 80, e.g., $V^M_{COMP}=V^M_{CALC}-V^M_{CORR}$.

Thus, the compensated first ink amount represents the present amount of the first ink in the first ink chamber, i.e., ink chamber 80 of color multi-chambered ink reservoir 38, and may be displayed, for example, by host 12 on its monitor. The compensated first ink amount may also be used in performing other calculations, such as for example, for determining various levels of ink usage.

Figure 5B:
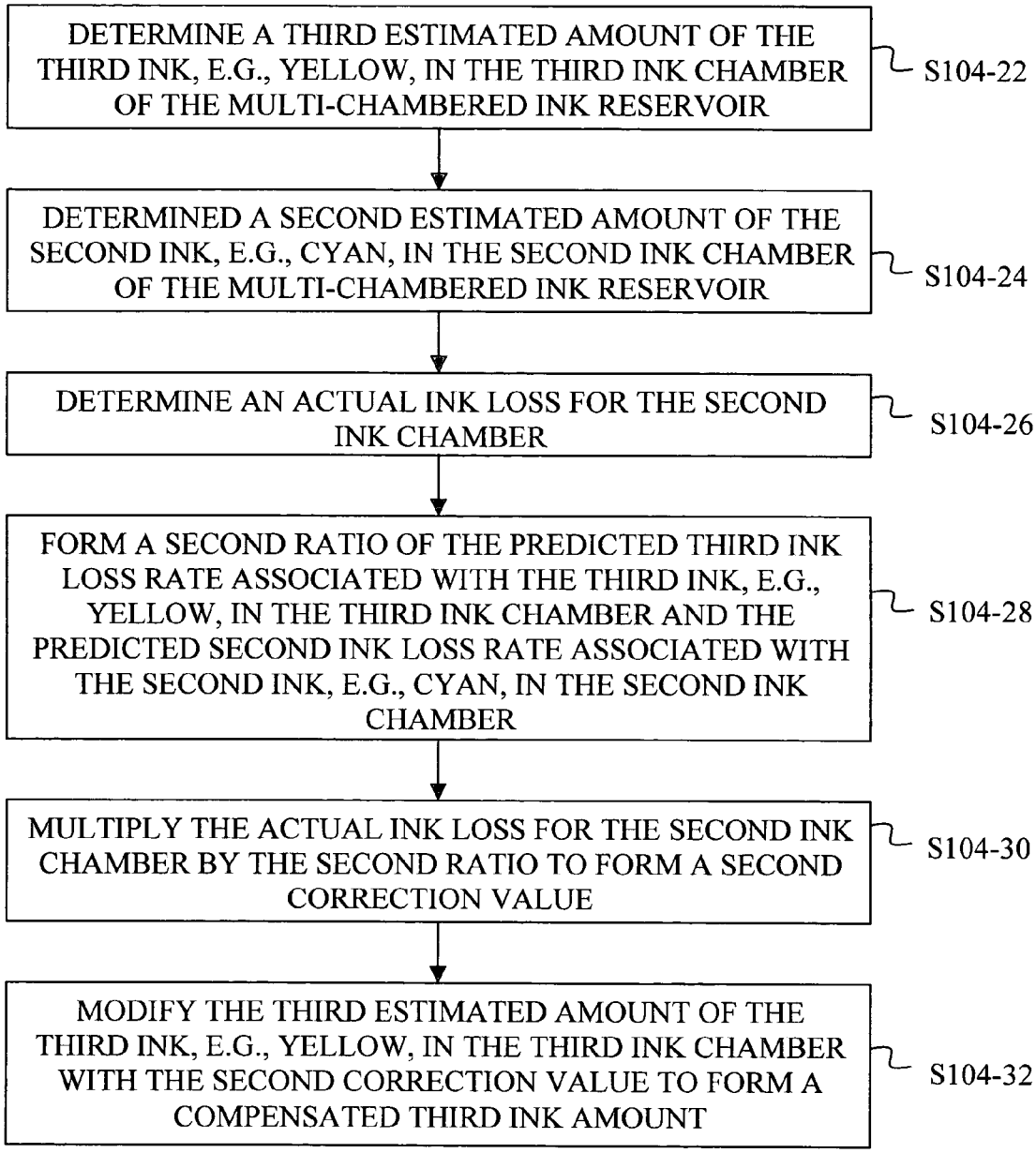
FIG. 5B is a flowchart of an exemplary calculating routine for use in implementing calculating step S104 of FIG. 4 for the third ink in the third ink chamber of the multi-chambered ink reservoir of FIG. 2.

FIG. 5B is a flowchart of an exemplary calculating routine for use in implementing calculating step S104 of FIG. 4 for determining an amount of the third ink, e.g., yellow, in ink chamber 84 of multi-chambered ink reservoir 38 of FIG. 2.

At step S104-22, a third estimated amount ($V^Y_{CALC}$) of the third ink, i.e., yellow, in the third ink chamber, i.e., ink chamber 84, of multi-chambered ink reservoir 38 is determined based on a third number of ink drops ($V^Y_{DROP}$) expelled from ink chamber 84. The number of ink drops expelled from ink chamber 84 may be determined, for example by counting the number of actuations of actuators 108 associated with ink chamber 84, as described above, and may be performed, for example, by controller 24. The third estimated amount ($V^Y_{CALC}$) of the third ink may be calculated by subtracting the third number of ink drops ($V^Y_{DROP}$) from the total ink amount ($V^Y_{TOTAL}$) originally available from the third ink chamber, i.e., ink chamber 84, e.g., $V^Y_{CALC}=V^Y_{TOTAL}-V^Y_{DROP}$.

At step S104-24, the second estimated amount ($V^C_{CALC}$) of the second ink, e.g., cyan, in the second ink chamber, i.e., ink chamber 82, of multi-chambered ink reservoir 38 is determined using the second number of ink drops ($V^C_{DROP}$) expelled from ink chamber 82. The number of ink drops expelled from ink chamber 82 may be determined, for example by counting the number of actuations of actuators 108 associated with ink chamber 82, as described above, and may be performed, for example, by controller 24. The second estimated amount ($V^C_{CALC}$) of the second ink may be calculated by subtracting the second number of ink drops $V^C_{DROP}$ from the total ink amount $V^C_{TOTAL}$ originally available from the second ink chamber, i.e., ink chamber 82, e.g., $V^C_{CALC}=V^C_{TOTAL}-V^C_{DROP}$.

At step S104-26, an actual ink loss ($V^C_{LOSS}$) for the second ink chamber, i.e., ink chamber 82, is determined by controller 24 by finding a difference between the amount of the second ink measured ($V^C_{MEAS}$) in ink chamber 82 and the second estimated amount ($V^C_{CALC}$) of the second ink in second ink chamber 82, e.g., $V^C_{LOSS}=V^C_{CALC}-V^C_{MEAS}$.

At step S104-28, controller 24 forms a second ratio ($R_2$) of the predicted third ink loss rate ($L_Y$) associated with the third ink, e.g., yellow, in ink chamber 84 and the predicted second ink loss rate ($L_C$) associated with the second ink, e.g., cyan, in ink chamber 82, e.g., $R_2=L_Y/L_C$.

At step S104-30, controller 24 multiplies the actual ink loss ($V^C_{LOSS}$) for the second ink chamber, i.e., ink chamber 82, by the second ratio ($R_2$) to form a second correction value ($V^Y_{CORR}$), e.g., $V^Y_{CORR}=V^C_{LOSS}\times R_2$, which represents the amount of ink loss from the third ink chamber, i.e., ink chamber 84.

At step S104-32, controller 24 modifies the third estimated amount ($V^Y_{CALC}$) of the third ink, e.g., yellow, in ink chamber 84 with the second correction value ($V^Y_{CORR}$) to form a compensated third ink amount ($V^Y_{COMP}$). This step of modifying the third estimated amount of the third ink in ink chamber 84 may be performed, for example, by subtracting the third correction value from the third estimated amount of the third ink in ink chamber 84, e.g., $V^Y_{COMP}=V^Y_{CALC}-V^Y_{CORR}$.

Thus, the compensated third ink amount represents the present amount of the third ink in the third ink chamber, i.e., ink chamber 84 of color multi-chambered ink reservoir 38, and may be displayed, for example, by host 12 on its monitor. The compensated third ink amount may also be used in performing other calculations, such as for example, for determining various levels of ink usage.

It is contemplated that in some implementations of the present invention, the first ratio formed at step S104-8 may be a fixed value, such as for example, some positive number, in which case step S104-8 may be omitted, and the fixed value may be substituted into the calculation at step S104-10 for calculating the first correction value for determining the compensated first ink amount associated with the first ink chamber, i.e., ink chamber 80 in the example above. Likewise, it is contemplated that in some implementations of the present invention, the second ratio formed at step S104-28 may be a fixed value, such as for example, a positive number, in which case step S104-28 may be omitted, and the fixed value may be substituted into the calculation at step S104-30 for calculating the second correction value in determining the compensated third ink amount associated with the third ink chamber, i.e., ink chamber 84 in the example above.

Furthermore, it is contemplated that in some implementations of the present invention, the first ratio formed at step S104-8 may be the special case of being 1, in which case steps S104-8 and S104-10 may be omitted, and the actual ink loss for the second ink chamber then used as the first correction value in determining the compensated first ink amount associated with the first ink chamber, i.e., ink chamber 80 in the example above. Likewise, it is contemplated that in some implementations of the present invention, the second ratio formed at step S104-28 may be the special case of being 1, in which case steps S104-28 and S104-30 may be omitted, and the actual ink loss for the second ink chamber then used as the second correction value in determining the compensated third ink amount associated with the third ink chamber, i.e., ink chamber 84 in the example above.

While this invention has been described with respect to particular embodiments, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of ink level determination for multiple ink chambers, comprising the steps of:

determining a first estimated amount of a first ink in a first ink chamber;

determining a second estimated amount of a second ink in a second ink chamber;

measuring an amount of said second ink contained in said second ink chamber;

determining an actual ink loss for said second ink chamber by finding a difference between said amount of said second ink measured in said second ink chamber and said second estimated amount of said second ink in said second ink chamber; and modifying said first estimated amount of said first ink in said first ink chamber using said actual ink loss for said second ink chamber to form a compensated first ink amount.

2. The method of claim 1, said first ink being one of a pigment ink and a dye-based ink, and said second ink being one of said pigment ink and said dye-based ink.

3. The method of claim 1, said first ink being one of cyan ink, a magenta ink, a yellow ink and a black ink, and said second ink being another of said cyan ink, said magenta ink, said yellow ink and said black ink.

4. The method of claim 1, further comprising the steps of:

establishing a predicted first ink loss rate associated with said first ink contained in said first ink chamber using empirical data;

establishing a predicted second ink loss rate associated with said second ink in said second ink chamber using empirical data;

forming a first ratio of said predicted first ink loss rate associated with said first ink in said first chamber and said predicted second ink loss rate associated with said second ink in said second chamber;

multiplying said actual ink loss for said second ink chamber by said first ratio to form a first correction value; and modifying said first estimated amount of said first ink in said first ink chamber with said first correction value to form said compensated first ink amount.

5. The method of claim 4, wherein the step of modifying said first estimated amount of said first ink in said first ink chamber is performed by subtracting said first correction value from said first estimated amount of said first ink in said first ink chamber.

6. The method of claim 4, wherein said first ratio is a fixed value.

7. The method of claim 1, further comprising the steps of:

determining a third estimated amount of a third ink in a third ink chamber; and modifying said third estimated amount of said third ink in said third ink chamber using said actual ink loss for said second ink chamber to form a compensated third ink amount.

8. The method of claim 7, further comprising the steps of:

establishing a predicted third ink loss rate associated with said third ink in said third ink chamber;

establishing a predicted second ink loss rate associated with said second ink in said second ink chamber;

forming a second ratio of said predicted third ink loss rate associated with said third ink in said third ink chamber and said predicted second ink loss rate associated with said second ink in said second chamber;

multiplying said actual ink loss for said second ink chamber by said second ratio to form a second correction value; and modifying said third estimated amount of said third ink in said third ink chamber with said second correction value to form said compensated third ink amount.

9. The method of claim 8, wherein the step of modifying said third estimated amount of said third ink in said third ink chamber is performed by subtracting said second correction value from said third estimated amount of said third ink in said third ink chamber.

10. The method of claim 1, wherein said multiple ink chambers are formed in a multi-chambered ink reservoir.

11. An ink jet printer, comprising:

a printhead carrier system including a carrier;

at least a first ink chamber and a second ink chamber;

a printhead mounted to said carrier, said printhead having a plurality of nozzles coupled in fluidic communication with said first ink chamber and said second ink chamber;

a plurality of actuators, each actuator being associated with a respective nozzle of said plurality of nozzles;

a sensor configured to detect an ink level in said second ink chamber;

and a controller electrically connected to said plurality of actuators and to said sensor, said controller configured to perform the steps of:

determining a first estimated amount of a first ink in said first ink chamber;

determining a second estimated amount of a second ink in said second ink chamber;

measuring an amount of said second ink contained in said second ink chamber;

determining an actual ink loss for said second ink chamber by finding a difference between said amount of said second ink measured in said second ink chamber and said second estimated amount of said second ink in said second ink chamber; and modifying said first estimated amount of said first ink in said first ink chamber using said actual ink loss for said second ink chamber to form a compensated first ink amount.

12. The ink jet printer of claim 11, said first ink being one of a pigment ink and a dye-based ink, and said second ink being one of said pigment ink and said dye-based ink.

13. The ink jet printer of claim 11, said first ink being one of cyan ink, a magenta ink, a yellow ink and a black ink, and said second ink being another of said cyan ink, said magenta ink, said yellow ink and said black ink.

14. The ink jet printer of claim 11, said controller configured to perform the steps of:

identifying a predicted first ink loss rate associated with said first ink contained in said first ink chamber using empirical data;

identifying a predicted second ink loss rate associated with said second ink in said second ink chamber using empirical data;

forming a first ratio of said predicted first ink loss rate associated with said first ink in said first chamber and said predicted second ink loss rate associated with said second ink in said second chamber;

multiplying said actual ink loss for said second ink chamber by said first ratio to form a first correction value; and modifying said first estimated amount of said first ink in said first ink chamber with said first correction value to form said compensated first ink amount.

15. The ink jet printer of claim 14, wherein the step of modifying said first estimated amount of said first ink in said first ink chamber is performed by subtracting said first correction value from said first estimated amount of said first ink in said first ink chamber.

16. The ink jet printer of claim 14, wherein said first ratio is a fixed value.

17. The ink jet printer of claim 11, said controller configured to perform the steps of:

determining a third estimated amount of a third ink in a third ink chamber; and modifying said third estimated amount of said third ink in said third ink chamber using said actual ink loss for said second ink chamber to form a compensated third ink amount.

18. The ink jet printer of claim 17, said controller configured to perform the steps of:

identifying a predicted third ink loss rate associated with said third ink in said third ink chamber;

identifying a predicted second ink loss rate associated with said second ink in said second ink chamber;

forming a second ratio of said predicted third ink loss rate associated with said third ink in said third ink chamber and said predicted second ink loss rate associated with said second ink in said second chamber;

multiplying said actual ink loss for said second ink chamber by said second ratio to form a second correction value; and modifying said third estimated amount of said third ink in said third ink chamber with said second correction value to form said compensated third ink amount.

19. The ink jet printer of claim 18, wherein the step of modifying said third estimated amount of said third ink in said third ink chamber is performed by subtracting said second correction value from said third estimated amount of said third ink in said third ink chamber.

20. The ink jet printer of claim 11, wherein said first ink chamber and said second ink chamber are formed in a multi-chambered ink reservoir.

* * * * *